US007556528B1

(12) United States Patent
Ju

(10) Patent No.: US 7,556,528 B1
(45) Date of Patent: Jul. 7, 2009

(54) ELECTRICAL CONNECTION APPARATUS

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/188,254

(22) Filed: Aug. 8, 2008

(51) Int. Cl.
*H01R 13/60* (2006.01)

(52) U.S. Cl. ..... 439/541.5; 439/79

(58) Field of Classification Search ..... 439/79, 439/541.5, 607

See application file for complete search history.

(56) References Cited

U.S. PATENT DOCUMENTS 6,540,563 B1 * 4/2003 Hu et al. ..... 439/676
7,044,790 B2 * 5/2006 Zhu et al. ..... 439/607
7,410,391 B2 * 8/2008 Wan et al. ..... 439/607
7,470,146 B1 * 12/2008 Chen ..... 439/541.5
7,473,136 B2 * 1/2009 Hu et al. ..... 439/607

* cited by examiner

*Primary Examiner*—Thanh-Tam T Le
(74) *Attorney, Agent, or Firm*—Morris, Manning & Martin LLP; Tim Tingkang Xia

(57) ABSTRACT

An electrical connecting apparatus of the invention comprise an insulating body, a rear plug, and a plurality of conductive terminals. The insulating body comprises at least one first inserting portion, and a plurality of step portions being disposed at a back side of the insulating body. The step portions are arranged in the front and rear and divided into at least three groups. The rear plug, installed onto the back side of the insulating body, has a warped surface on a front side thereof. The first conductive terminals are correspondingly accommodated in the first inserting portion. Each of the first conductive terminals respectively comprises a mating portion accommodated in the first inserting portion and comprises a terminal pin extended and bent downward from the mating portion to the back side of the insulating body. The terminal pins are correspondingly disposed between one of the step portions and the warped surface.

18 Claims, 9 Drawing Sheets

ELECTRICAL CONNECTION APPARATUS

BACKGROUND OF THE INVENTION

1. Field of the Invention

The invention relates to an electrical connecting apparatus and, more particularly, to an electrical connecting apparatus capable of connecting a variety of components.

2. Description of the Prior Art

A conventional connecting apparatus, e.g. a High Definition Multimedia Interface (HDMI) connector, comprises an insulating body, a plurality of conductive terminals accommodated in the insulating body, and two rear plugs attached on the insulating body. There is a plurality of first recesses disposed on a back side of the insulating body. There is a first protruding rib disposed between every two adjacent the first recesses. Each of the conductive terminals comprises a mating portion and a terminal pin, which is bent downward and extends from a back end of the mating portion. The mating portions are arranged in two rows at up and down direction. The terminal pins are arranged in three rows at front and rear direction. The two rear plugs are respectively a first rear plug and a second rear plug arranged in the front and rear. There is a plurality of second recesses, which is corresponding to the first protruding ribs, disposed on a front side of the first rear plug. There is a second protruding rib, which is corresponding to the first recesses, disposed between every two adjacent second recesses. The second protruding ribs cooperate with the first recesses to fix the first row of the terminal pins. The second recesses cooperate with the first protruding ribs to fix the middle row of the terminal pins. The last row of the terminal pins is fixed between the back end of the first rear plug and the second rear plug. However, since the electrical connecting apparatus needs two rear plugs for fixing the three rows of the terminal pins of the conductive terminals, one rear plug cannot fix the three rows of the terminal pins at the same time.

Currently, there is a solution for the aforesaid problem. The solution is to form a plurality of holes on one rear plug for accommodating three rows of the terminal pins. However, since there are a lot of long and thin conductive terminals, the corresponding holes must be highly concentrated, such that the process of assembling the conductive terminals will get complicated.

Therefore, it is necessary to design a new electrical connecting apparatus to solve the aforesaid problems.

SUMMARY OF THE INVENTION

A scope of the invention is to provide an electrical connecting apparatus capable of utilizing one rear plug to fix three rows of the conductive terminals.

To achieve the aforesaid scope, an electrical connecting apparatus of the invention comprises an insulating body, a rear plug, and a plurality of first conductive terminals. The insulating body comprises at least one first inserting portion, and a plurality of step portions is disposed at a back side of the insulating body, wherein the step portions are arranged in the front and rear and divided into at least three groups. The rear plug, installed onto the back side of the insulating body, has a warped surface on a front side thereof. The first conductive terminals are correspondingly accommodated in the first inserting portion. Each of the first conductive terminals respectively comprises a mating portion accommodated in the first inserting portion and comprising a terminal pin extended and bent downward from the mating portion to the back side of the insulating body. The terminal pins are correspondingly disposed between one of the step portions and the warped surface.

Comparing the electrical connecting apparatus of the invention with the prior art, the insulating body of the invention has the step portions, which are arranged in the front and rear and divided into at least three groups. The rear plug has a warped surface on a front side thereof. The terminal pins are correspondingly disposed between one of the step portions and the warped surface. Consequently, only one rear plug is needed to cooperate with the insulating body for fixing the terminal pins.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
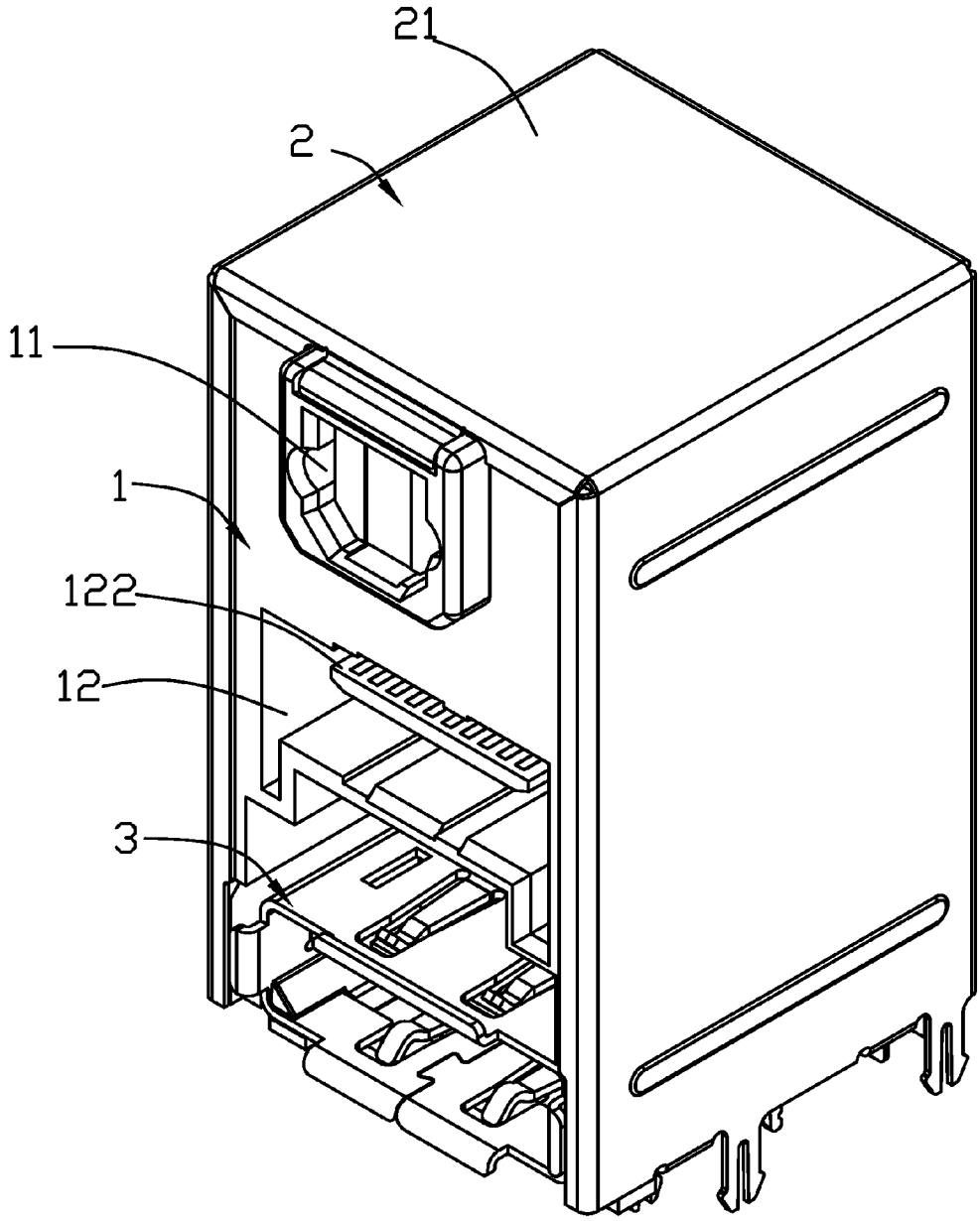
FIG. 1 is a perspective view illustrating an electrical connecting apparatus of the invention.

The advanced description with figures and embodiments is mentioned in the following.

Please refer to FIG. 1 to FIG. 10. The electrical connecting apparatus of the invention comprises an insulating body 1, a shielding casing 2, an electrical connector 3, a rear plug 4, a shielding plate 5, and a plurality of conductive terminals 6. The shielding casing 2 covers the insulating body 1. The electrical connector 3 is disposed within the insulating body 1. In this embodiment, the electrical connector 3 is a Displayport connector. The rear plug 4 is installed onto the insulating body 1. The shielding plate 5 is installed onto the insulating body 1. The conductive terminals 6 comprise a plurality of first conductive terminals 61 and a plurality of second conductive terminals 62, which are accommodated in the insulating body 1.

Please refer to FIG. 2, FIG. 4, FIG. 5, FIG. 7, and FIG. 10. The insulating body 1, which is formed integrally, comprises a second inserting portion 11 and a first inserting portion 12, which are respectively arranged upper and lower. The first inserting portion 12 accommodates the plurality of first conductive terminals 61. The second inserting portion 11 accommodates a light emitting device 15 and the plurality of second conductive terminals 62 within the light emitting device 15. In this embodiment, the first conductive terminals 61 are terminals of High Definition Multimedia Interface (HDMI) electrical connector, and the second conductive terminals 62 are terminals of an optical fiber electrical connector.

At a front end of the insulating body 1, there is a first sliding groove 111 disposed on a top side of the second inserting portion 11. The second inserting portion 11 may accommodate a dustproofing plate 71. A containing groove 711 is disposed on the top of the dustproofing plate 71. A main body of a resilient member 72 is accommodated in the containing groove 711. One end of the resilient member 72 is against the dustproofing plate 71, while the other end is against the shielding casing 2. Two stopping blocks 113, which are corresponding to the dustproofing plate 71, are disposed at a rear end of the insulating body 1. A formed-through hole 114 is disposed beneath the stopping blocks 113. The light emitting device 15 is accommodated beneath the stopping blocks 113 as well.

At the front end of the insulating body 1, there are two second sliding grooves 121 respectively disposed on an upper and a lower side of the first inserting portion 12. A tongue portion 122 is disposed in the middle of the first inserting portion 12. On the upper and lower surfaces of the tongue portion 122, there is a plurality of separated second terminal receiving grooves 123, which is formed through the back of the insulating body 1 and used for accommodating the first conductive terminals 61. On the back of the insulating body 1, there is a plurality of step portions 13 arranged in the front and rear and divided into at least three groups. At the back of the insulating body 1, the step portions 13 comprises a plurality of first resisting portions 125, a plurality of terminal channels 124, and a plurality of second resisting portions 126. The terminal channels 124 are concavely disposed relative to the first resisting portions 125. The second resisting portions 126 are disposed relative protrudent from the first resisting portions 125. The terminal channels 124 are formed through the second terminal receiving grooves 123 at a bottom surface of the tongue portion 122. The second resisting portions 126 are protruded backward from the terminal channels 124. Three first resisting portions 125 and two terminal channels 124 are disposed between two adjacent second resisting portions 126. Each of the terminal channels 124 is disposed between two adjacent first resisting portions 125.

Besides, there is an accommodating space 14 disposed under the first inserting portion 12 of the insulating body 1. The accommodating space 14 is used for accommodating the electrical connector 3.

Please refer to FIG. 1, FIG. 2, FIG. 8 and FIG. 10. Each of the first conductive terminals 61 respectively comprises a mating portion 610 accommodated in the second terminal receiving grooves 123 of the first inserting portion 12. Each first conducive terminal 61 also comprises a terminal pin 611 extended and bent downward from the mating portion 610 to the back side of the insulating body 1.

The mating portions 610 comprise an upper row of mating portions and a lower row of mating portions. Each of the mating portions 610 comprises a contact portion 6101, which is connected to a connecting member, and a connecting portion 6102, which is located behind the contact portion 6101. The connecting portion 6102 has fixing structures capable of being fixed within the second terminal receiving grooves 123 of the insulating body 1. Each of the first terminal pins 611 comprises a welding portion 6111, which is exposed outside the insulating body 1 and used for being welded to a circuit board, and a transitional portion 6112, which is used for connecting the connecting portion 6102 and the welding portion 6111. One part of the lower row of mating portions 610 extends downward to form one row of first terminal pins 6113. Another part of the lower row of mating portions 610 extends with a specific length and then is bent downward to form one row of third terminal pins 6115. The upper row of mating portions 610 extends downward to form one row of second terminal pins 6114. Two first terminal pins 6113 are disposed between two adjacent third terminal pins 6115. Accordingly, the first, second, and third terminal pins are arranged in three rows from front to rear. Each of the welding portions of the first terminal pins 6113 is bent and extended from the transitional portion (as 6113, 6114 and 6115 shown in FIG. 10). Therefore, the welding portions of the first terminal pins 6113 are arranged apart by an identical distance, so as to solve the problem occurred when the first conductive terminal 61 is transmitting a high frequency signal.

Figure 2:
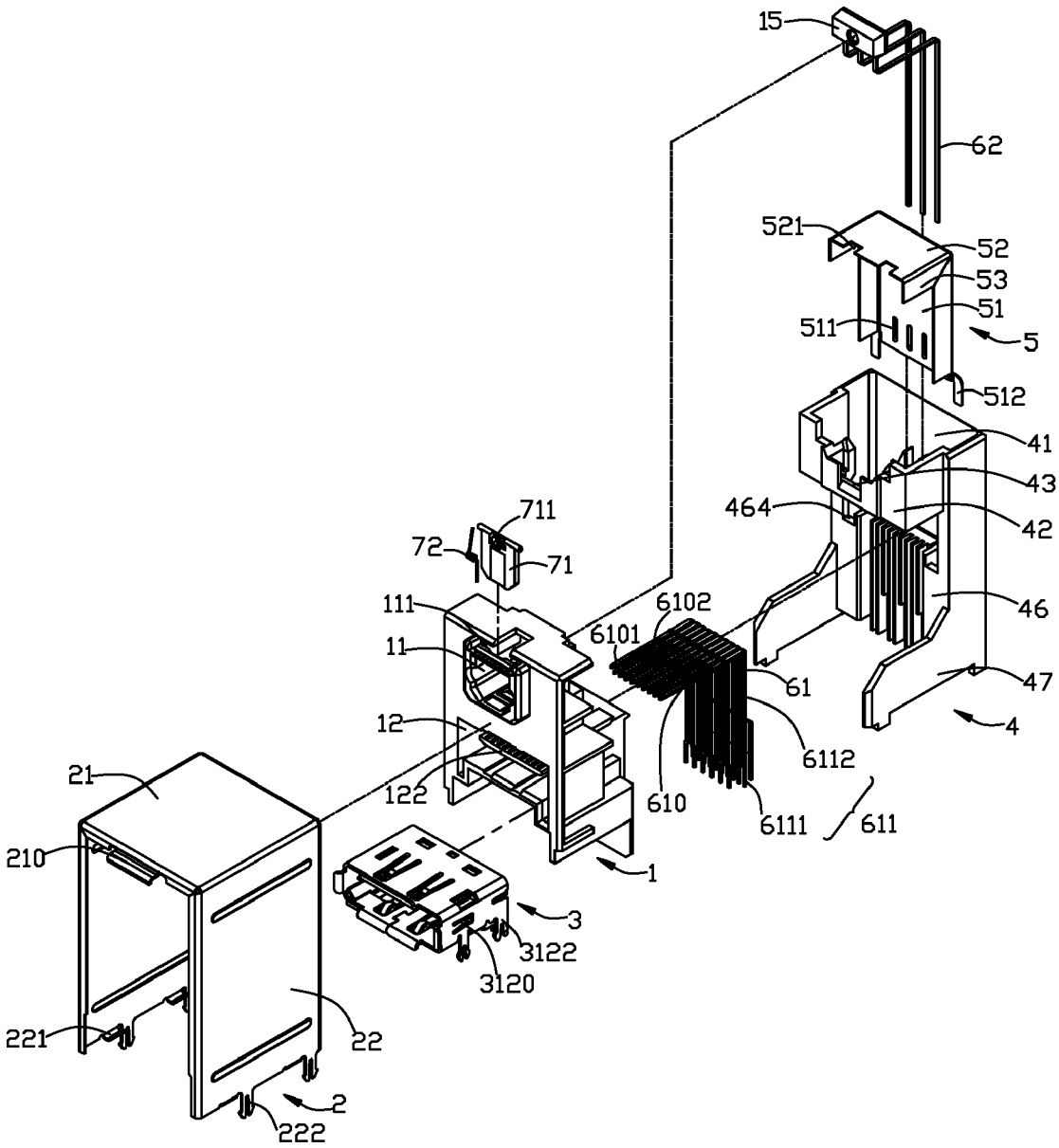
FIG. 2 is an exploded view illustrating the electrical connecting apparatus shown in FIG. 1.

Please refer to FIG. 2. The shielding casing 2 comprises a top wall 21 and a pair of second side walls 22 extending from both sides of the top wall 21. At a front edge of the top wall 21, there is a first clasping portion 210. At a bottom edge of the second side walls 22, there are two second clasping portions 221, which are bent inward. There are two second pins 222 extending from the bottom edge of the second side walls 22. The two second pins 222 are used for fixing the electrical connecting apparatus onto a circuit board (not shown).

Figure 3:
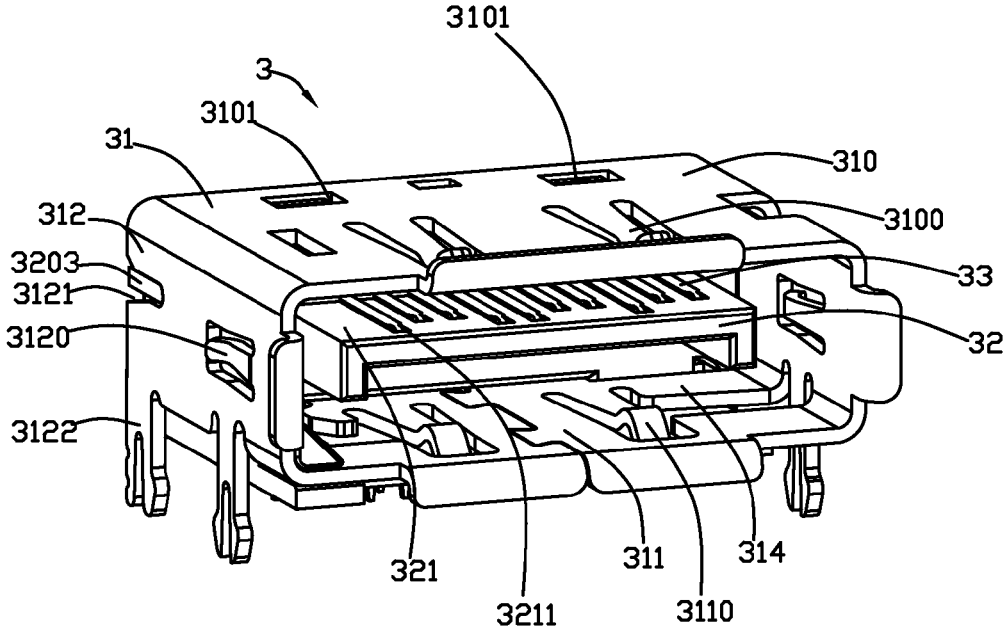
FIG. 3 is a perspective view illustrating an electrical connector of the electrical connecting apparatus shown in FIG. 1.
Figure 4:
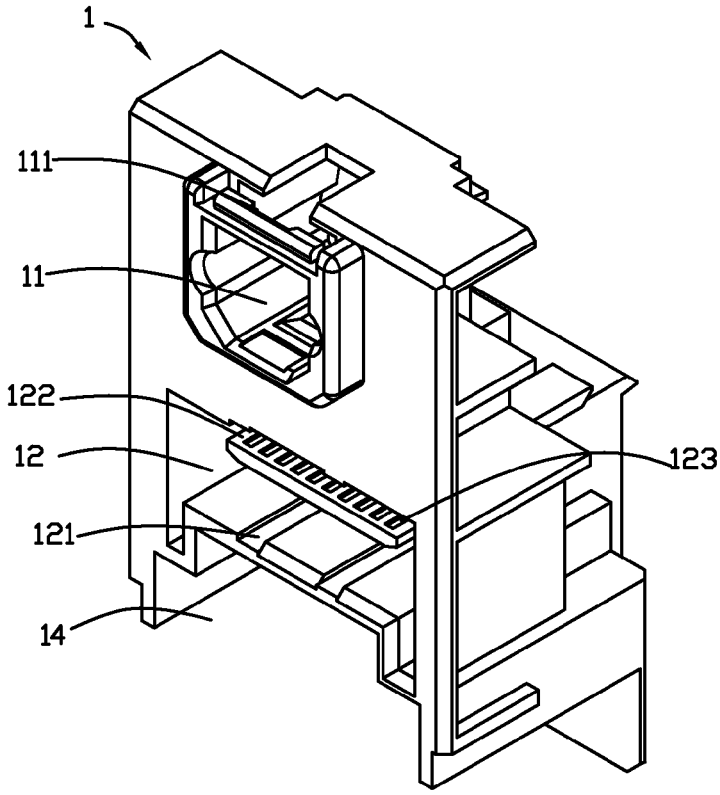
FIG. 4 is a perspective view illustrating an insulating body of the electrical connecting apparatus shown in FIG. 1.
Figure 5:
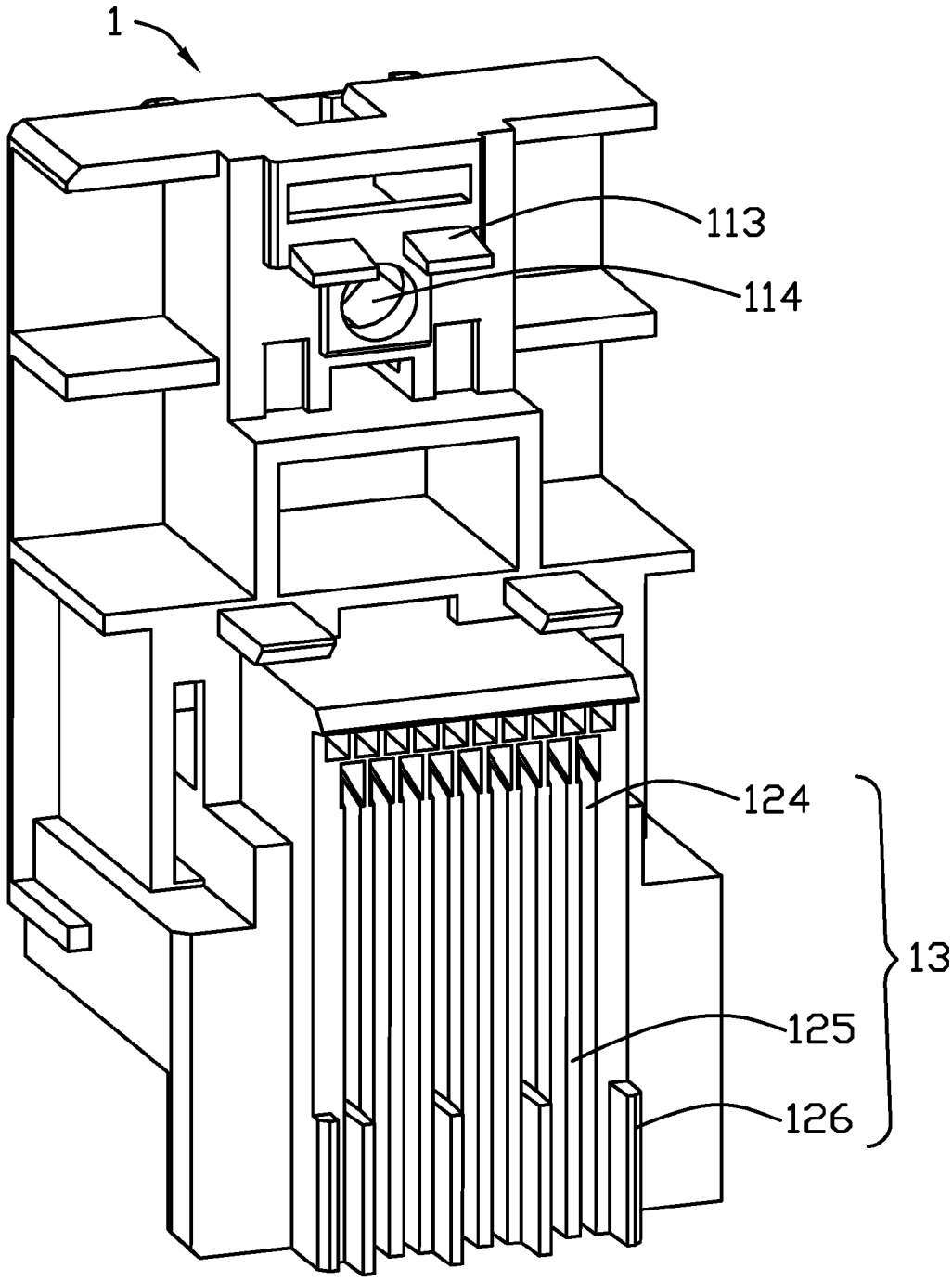
FIG. 5 is a perspective view illustrating the insulating body shown in FIG. 4 based on another view angle.
Figure 6:
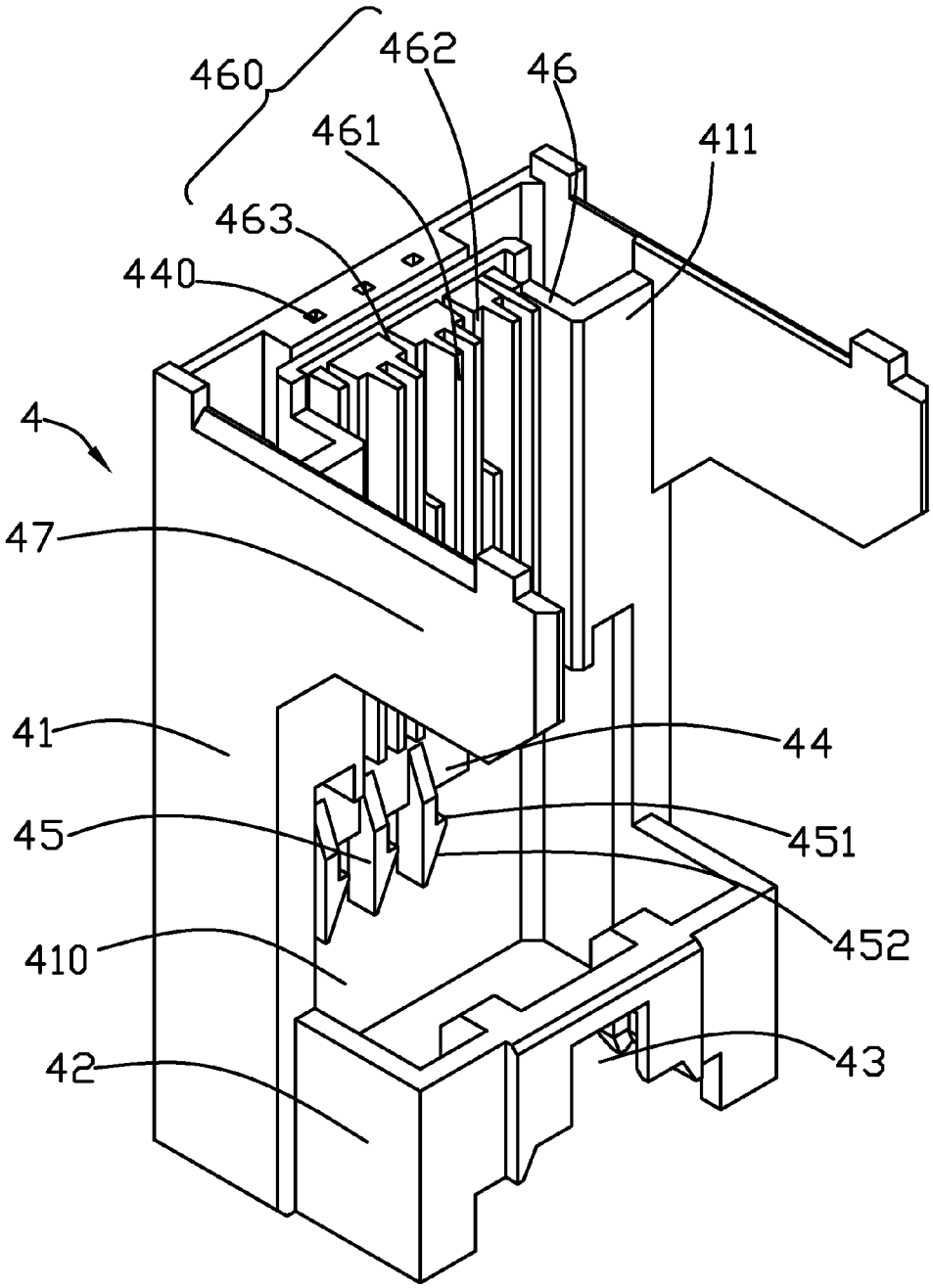
FIG. 6 is a perspective view illustrating a rear plug of the electrical connecting apparatus shown in FIG. 1 based on another view angle.
Figure 8:
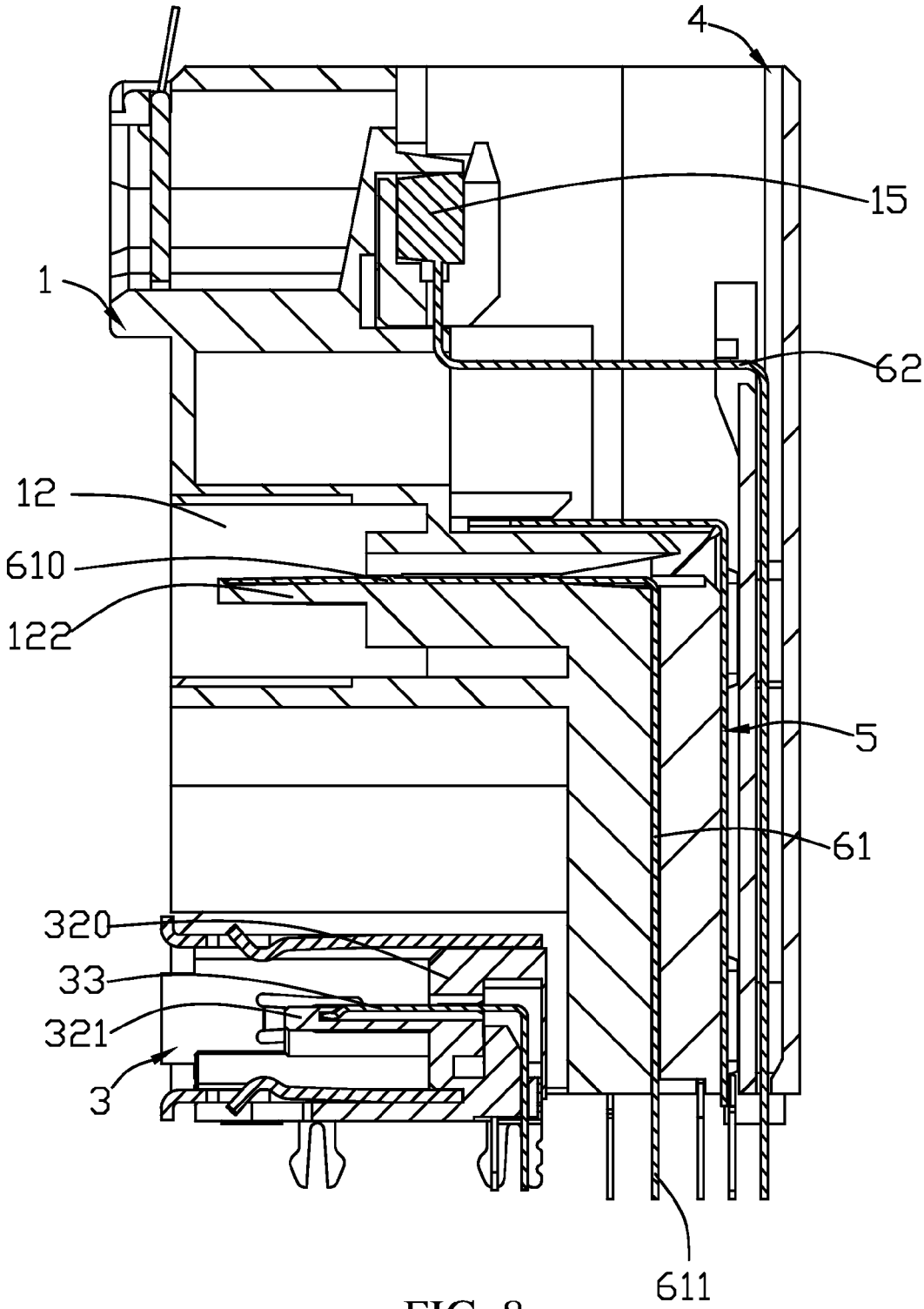
FIG. 8 is a sectional view illustrating the electrical connecting apparatus along line A-A shown in FIG. 7.
Figure 9:
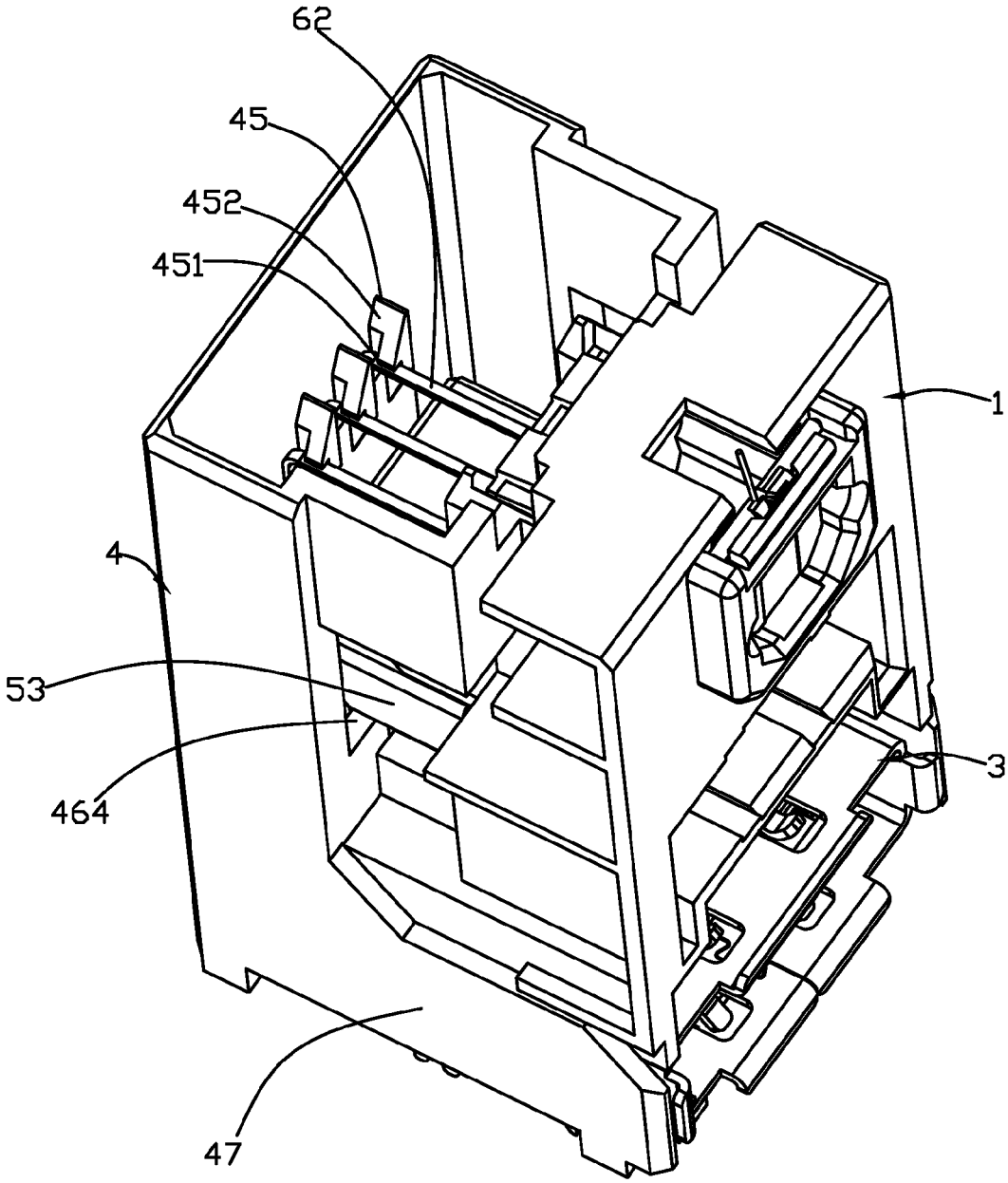
FIG. 9 is a perspective view illustrating the electrical connecting apparatus without a shielding casing shown in FIG. 7 based on another view angle.
Figure 10:
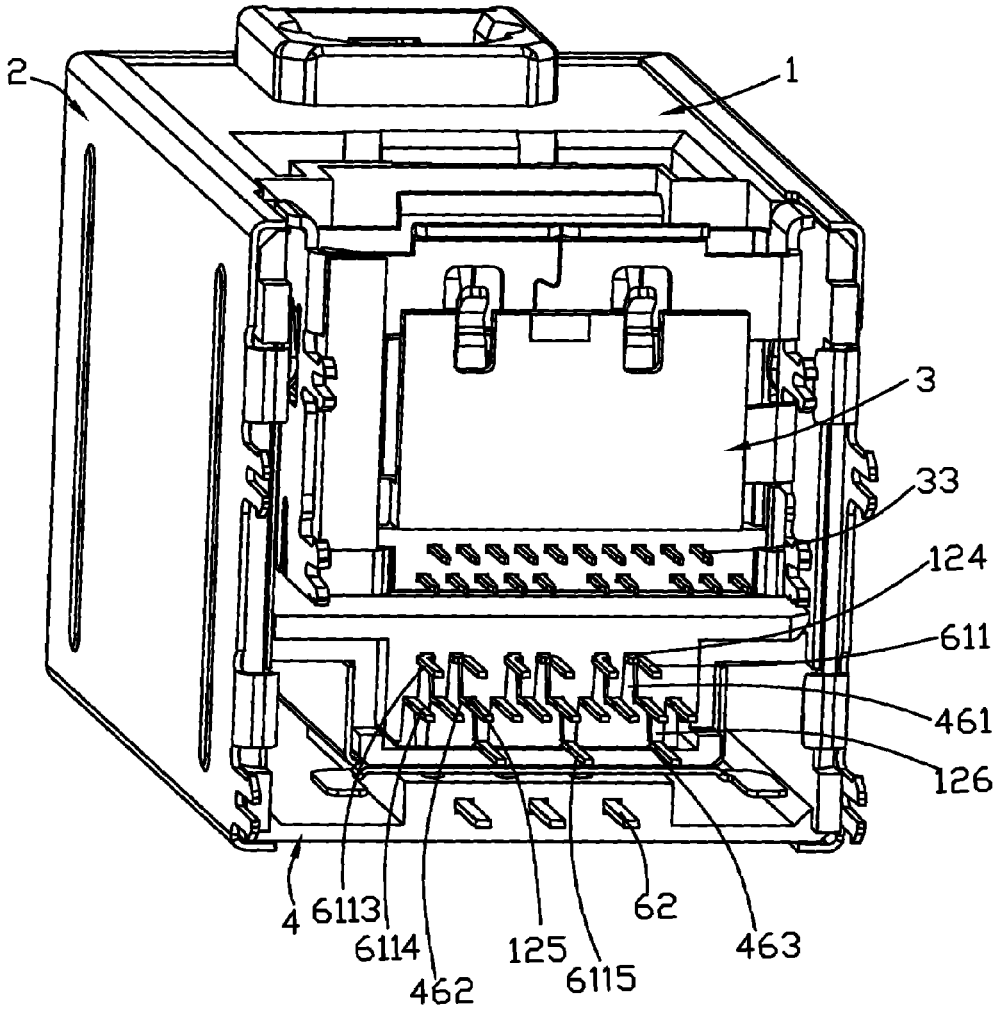
FIG. 10 is a perspective view illustrating the electrical connecting apparatus shown in FIG. 1 based on another view angle.

Please refer to FIG. 2, FIG. 3, and FIG. 8. The electrical connector 3 comprises an outer case 31, a third main body 32 disposed and fixed in the outer case 31, and a plurality of third conductive terminals 33 accommodated in the third main body 32 (as shown in FIG. 3).

The outer case 31 has an upper side wall 310, a lower side wall 311 opposite to the upper side wall 310, and two first side walls 312 opposite to each other. Those four side walls surround each other to form a connecting frame 314 for connecting a connector. The connecting frame 314 is used to accommodate the third main body 32 and receive a connecting member (not shown). On the upper side wall 310, there are two identical first resilient pieces 3100 and two identical square holes 3101. The two first resilient pieces 3100 are close to a front edge of the upper side wall 310, while the two square holes 3101 are close to a rear edge of the upper side wall 310. On the lower side wall 311, there are two identical second resilient pieces 3110 located corresponding to the first resilient pieces 3100. On each of the first side walls 312, there is respectively a third resilient piece 3120 close to the front edge. The first, second, and third resilient pieces 3100, 3110, 3120 are respectively bent from each side wall into the connecting frame 314 and are able to be respectively against and fix the connecting member (not shown). On each of the first side walls 312, there is an engaging groove 3121 close to the rear edge. There are two first pins 3122 extending from the bottom of each first side wall 312, wherein there is a specific distance from one first pin 3122 to the other. The first pins 3122 are used for fixing the electrical connecting apparatus onto a circuit board (not shown).

The third main body 32 is disposed in the connecting frame 314 of the outer case 31. The third main body 32 comprises a base portion 320 and a tongue plate 321 extending from a front edge of the base portion 320. There are two identical protruding blocks 3201 disposed on a top surface of the base portion 320. The two protruding blocks 3201 can respectively engage with the two corresponding square holes 3101 of the outer case 31. On each of the right and left side surfaces of the base portion 320, there is respectively a protruding portion 3203, which is corresponding to the engaging groove 3121 of the outer case 31. On an upper surface and a lower surface of the tongue plate 321, there is a plurality of first terminal receiving grooves 3211 for accommodating a plurality of third conductive terminals 33. The first terminal receiving grooves 3211 are formed through the base portion 320.

Please refer to FIG. 2, FIG. 5, FIG. 6, and FIG. 9. The rear plug 4 is installed onto the back side of the insulating body 1. The rear plug 4 comprises a base body 41. An accommodating frame 42 extends from two sides of an upper part of the base body 41. There is an engaging groove 43 at a front surface of the accommodating frame 42. The engaging groove 43 is used for accommodating and fixing the light emitting device 15. There is a backside plate 410 disposed on a back side of the base body 41. There is a protruding plate 44 protruded from a front surface of the backside plate 410. There is a plurality of terminal holes 440 formed through the top to the bottom of the protruding plate 44. The second conductive terminals 62 pass through the terminal holes 440. There is a plurality of engaging portions 45 disposed on an upper side of the protruding plate 44. A hook 451 is disposed on one side of the top of the engaging portion 45. An upper surface of the hook 451 descends to form a guiding surface 452. When the second conductive terminals 62 moves over the guiding surface 452, the second conductive terminals 62 are driven by the self-resilience and bounce back. Then, the second conductive terminals 62 are going to be pressed under the hook 451 and then fixed on the rear plug 4. On a front side 411 of the base body 41, there is a plate portion 46. There is a gap between the plate portion 46 and the protruding plate 44 for receiving the shielding plate 5. A warped surface 460 is formed on the plate portion 46. At the front of the plate portion 46, the warped surface 460 forms a plurality of third resisting portions 461, which are corresponding to the terminal channels 124. The warped surface 460 also forms a plurality of fourth resisting portions 462, which is caved in relative to the third resisting portions 461 and corresponds to the first resisting portions 125. The warped surface 460 still forms a plurality of recesses 463, which is caved in relative to the fourth resisting portions 462 and corresponds to the second resisting portions 126. The recesses 463 are formed by caving in from the third resisting portion 461. The first terminal pins are accommodated in the terminal channels and against the third resisting portions. At least one of the terminal pins is against between the first resisting portions and the fourth resisting portions. At least one of the terminal pins 6113 is against the second resisting portion 126 and is accommodated in the recesses 463. Each of two sides of the plate portion 46 has an opening 464 for restraining the shielding plate 5. Two side plates 47 respectively extend from two sides of a lower part of the base body 41.

Figure 7:
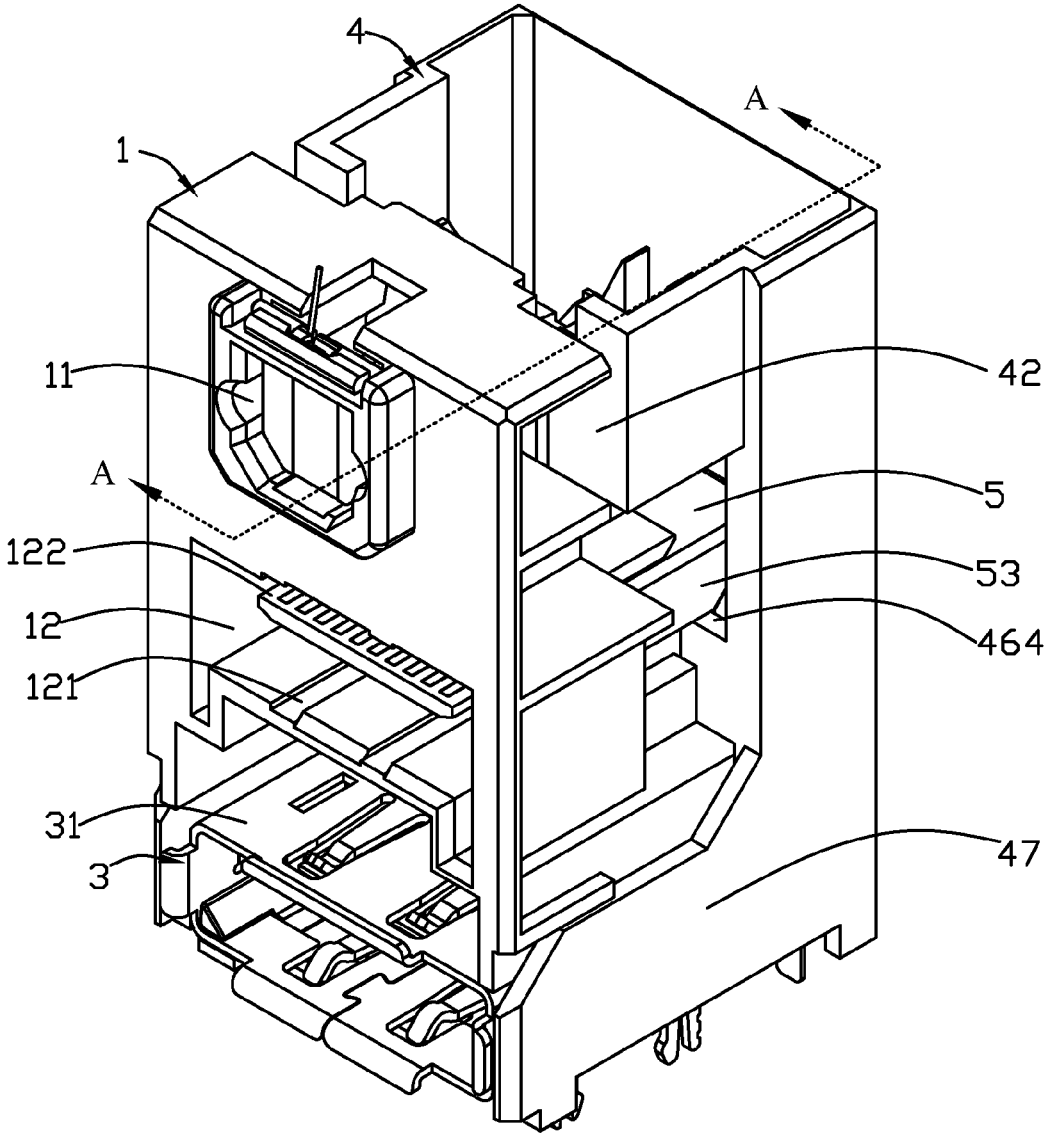
FIG. 7 is a perspective view illustrating the electrical connecting apparatus shown in FIG. 1 without a shielding casing.

Please refer to FIG. 2 and FIG. 7. The shielding plate 5 can prevent the electromagnetic interference between the second conductive terminals 62 and the first and third conductive terminals 61, 33. The shielding plate 5 comprises a back wall 51, a top portion 52 extending forward from the top of the back wall 51, and an extending portion 53 extending downward from two sides of the top portion 52. The back wall 51 is inserted into the gap between the plate portion 46 and the protruding plate 44. The back wall 51 has a plurality of enhancing ribs 511. A pair of bending portions 512 extends downward from two bottom sides of the back wall 51, respectively. A tooth-shaped groove 521 corresponding to the insulating body 1 is disposed on the front of the top portion 52. The extending portion 53 is engaged with the opening 464 (shown in FIG. 9) of the rear plug 4, so as to hold and fix the shielding plate 5 and the rear plug 4 together.

In assembling procedure, the second conductive terminals 62 are inserted into the light emitting device 15 first. Afterward, the light emitting device 15 is installed into the second inserting portion 11 of the insulating body 1. The first conductive terminals 61 are then inserted into the first inserting portion 12 of the insulating body 1, and the third electrical connector 3 is installed into the accommodating space 14 of the insulating body 1. Afterward, the shielding plate 5 is then installed onto the insulating body 1. Finally, the rear plug 4 is installed and fixed behind the insulating body 1, and the insulating body 1 is covered by the shielding casing 2, so as to complete the assembling of the electrical connecting apparatus.

The electrical connecting apparatus according to the invention comprises advantages as follows:

Comparing the electrical connecting apparatus of the invention with the prior art, there are a plurality of the step portions formed on the back side of the insulating body. There are at least three groups of the step portions. A warped surface is formed on the front side of the rear plug. The terminal pins respectively disposed between one of the step portions and the warped surface correspondingly, such that it needs only one rear plug to cooperate with the insulating body for fixing the terminal pins.

The rear plug of the invention has the engaging portions for fixing the second conductive terminals. The rear plug is able to fix the first conductive terminals at the same time. That is to say, it is unnecessary for the invention to utilize more than one rear plug to fix the first conductive terminals and the second conductive terminals. Therefore, compared to the prior art, the electrical connecting apparatus of the invention saves rear plugs, decreases producing cost, and enhances assembling performance.

The shielding plate of the invention is disposed between the plate portion of the rear plug and the protruding plate. It is unnecessary for the invention to utilize two independent components to fix the shielding plate, so as to enhance assembling performance.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electrical connecting apparatus comprising:

an insulating body comprising at least one first inserting portion, a plurality of step portions being disposed at a back side of the insulating body, the step portions being arranged in a front-to-back direction and being divided into at least three groups, wherein the step portions comprises at least one first resisting portion formed on the back side of the insulating body, at least one terminal channel formed forward from the first resisting portion, and at least one second resisting portion formed backward from the first resisting portion, three first resisting portions and two terminal channels are disposed between two adjacent second resisting portions, each of the terminal channels is disposed between two adjacent first resisting portions;

a rear plug, installed onto the back side of the insulating body, having a warped surface on a front side thereof; and a plurality of first conductive terminals correspondingly accommodated in the first inserting portion, each of the first conductive terminals respectively comprising a mating portion accommodated in the first inserting portion and comprising a terminal pin extended and bent downward from the mating portion to the back side of the insulating body, the terminal pins being correspondingly disposed between one of the step portions and the warped surface, wherein within the first conductive terminals, at least one of the terminal pins are located between the first resisting portion and the warped surface, at least one of the terminal pins are located between the terminal channel and the warped surface, and at least one of the terminal pins are located between the second resisting portion and the warped surface.

2. The electrical connecting apparatus of claim 1, wherein the second resisting portion protrudes backward from the terminal channel.

3. The electrical connecting apparatus of claim 1, wherein at least one third resisting portion, corresponding to the terminal channel, is disposed at the front side of the rear plug, at least one fourth resisting portion, corresponding to the first resisting portion, protrudes backward from the third resisting portion, and at least one recess, corresponding to the second resisting portion, protrudes backward from the fourth resisting portion.

4. The electrical connecting apparatus of claim 3, wherein at least one of the terminal pins is accommodated in the terminal channel and against the third resisting portion, at least one of the terminal pins is against between the first resisting portion and the fourth resisting portion, at least one of the terminal pins is accommodated in the recess and against the second resisting portion.

5. The electrical connecting apparatus of claim 3, wherein the recess is caved backward from the third resisting portion.

6. The electrical connecting apparatus of claim 1, wherein the mating portions comprises an upper row of mating portions and a lower row of mating portions.

7. The electrical connecting apparatus of claim 6, wherein one part of the lower row of mating portions extends downward to form one row of first terminal pins, another part of the lower row of mating portions extends with a specific length and then is bent downward to form one row of third terminal pins, the upper row of mating portions extends downward to form one row of second terminal pins.

8. The electrical connecting apparatus of claim 7, wherein two first terminal pins are disposed between two adjacent third terminal pins.

9. The electrical connecting apparatus of claim 7, wherein each of the first terminal pins comprises a welding portion exposed outside the insulating body, the welding portions are bent and arranged apart by an identical distance.

10. The electrical connecting apparatus of claim 1, wherein a second inserting portion is disposed on the insulating body, a plurality of second conductive terminals is accommodated in the second inserting portion.

11. The electrical connecting apparatus of claim 10, wherein the rear plug comprises a base body, a backside plate is disposed on a back side of the base body, a protruding plate is disposed on a front surface of the backside plate, terminal holes, which pass through a bottom surface of the protruding plate and are used for receiving the second conductive terminals, are disposed on the protruding plate.

12. The electrical connecting apparatus of claim 11, wherein a plurality of engaging portions is disposed on the protruding plate and used for fixing the second conductive terminals correspondingly.

13. The electrical connecting apparatus of claim 11, wherein a plate portion is disposed on a front side of the base body, the plate portion is in front of the protruding plate.

14. The electrical connecting apparatus of claim 13, wherein the warped surface is formed on the plate portion.

15. The electrical connecting apparatus of claim 13, wherein a gap is between the plate portion and the protruding portion, the electrical connecting apparatus further comprises a shielding plate, which is partly inserted into the gap.

16. The electrical connecting apparatus of claim 13, wherein a pair of openings is respectively disposed on both sides of the plate portion and used for restraining the shielding plate.

17. An electrical connecting apparatus comprising:

an insulating body comprising at least one first inserting portion, a plurality of step portions being disposed at a back side of the insulating body, the step portions being arranged in a front-to-back direction and being divided into at least three groups, wherein the step portions comprises at least one first resisting portion formed on the back side of the insulating body, at least one terminal channel formed forward from the first resisting portion, and at least one second resisting portion formed backward from the first resisting portion;

a rear plug, installed onto the back side of the insulating body, having a warped surface on a front side thereof; and a plurality of first conductive terminals correspondingly accommodated in the first inserting portion, each of the first conductive terminals respectively comprising a mating portion accommodated in the first inserting portion and comprising a terminal pin extended and bent downward from the mating portion to the back side of the insulating body, the terminal pins being correspondingly disposed between one of the step portions and the warped surface, wherein within the first conductive terminals, at least one of the terminal pins are located between the first resisting portion and the warped surface, at least one of the terminal pins are located between the terminal channel and the warped surface, and at least one of the terminal pins are located between the second resisting portion and the warped surface, at least one third resisting portion, corresponding to the terminal channel, is disposed at the front side of the rear plug, at least one fourth resisting portion, corresponding to the first resisting portion, protrudes backward from the third resisting portion, and at least one recess, corresponding to the second resisting portion, protrudes backward from the fourth resisting portion.

18. An electrical connecting apparatus comprising:

an insulating body comprising at least one first inserting portion, a plurality of step portions being disposed at a back side of the insulating body, the step portions being arranged in a front-to-back direction and being divided into at least three groups;

a rear plug, installed onto the back side of the insulating body, having a warped surface on a front side thereof; and a plurality of first conductive terminals correspondingly accommodated in the first inserting portion, each of the first conductive terminals respectively comprising a mating portion accommodated in the first inserting portion and comprising a terminal pin extended and bent downward from the mating portion to the back side of the insulating body, the terminal pins being correspondingly disposed between one of the step portions and the warped surface, wherein the mating portions comprises an upper row of mating portions and a lower row of mating portions, one part of the lower row of mating portions extends downward to form one row of first terminal pins, another part of the lower row of mating portions extends with a specific length and then is bent downward to form one row of second terminal pins, the upper row of mating portions extends downward to form one row of second terminal pins, two first terminal pins are disposed between two adjacent third terminal pins.

* * * * *